US009863234B2

(12) United States Patent
Zabotkin

(10) Patent No.: US 9,863,234 B2
(45) Date of Patent: Jan. 9, 2018

(54) METHOD AND SYSTEM FOR PRESSURE TESTING DOWNHOLE TUBULAR CONNECTIONS USING A REFERENCE PORT

(71) Applicant: Konstantin Zabotkin, Houston, TX (US)

(72) Inventor: Konstantin Zabotkin, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 412 days.

(21) Appl. No.: 14/575,371

(22) Filed: Dec. 18, 2014

(65) Prior Publication Data

US 2016/0177701 A1 Jun. 23, 2016

(51) Int. Cl.

| | |
|---|---|
| ***E21B 47/06*** | (2012.01) |
| ***E21B 47/00*** | (2012.01) |
| ***E21B 47/10*** | (2012.01) |

(52) U.S. Cl.

CPC ..... *E21B 47/0006* (2013.01); *E21B 47/06* (2013.01); *E21B 47/1025* (2013.01)

(58) Field of Classification Search

CPC ..... E21B 47/06; E21B 17/02; E21B 47/011; E21B 47/1025

See application file for complete search history.

(56) References Cited

U.S. PATENT DOCUMENTS

| | | | | |
|---|---|---|---|---|
| 3,165,920 | A * | 1/1965 | Loomis | E21B 47/1025 73/40.5 R |
| RE31,148 | E * | 2/1983 | Mayo | G01M 3/2853 73/40.5 R |
| 4,693,267 | A | 9/1987 | Patterson | |
| 4,790,380 | A * | 12/1988 | Ireland | E21B 17/003 166/250.07 |
| 5,072,622 | A * | 12/1991 | Roach | F16L 58/1036 73/40.5 R |
| 5,278,550 | A * | 1/1994 | Rhein-Knudsen | E21B 23/03 175/40 |
| 7,201,226 | B2 * | 4/2007 | Gambier | E21B 47/06 166/181 |
| 8,650,934 | B1 | 2/2014 | Levy | |
| 9,310,267 | B2 * | 4/2016 | Wagner | G01F 1/34 |
| 9,458,695 | B2 * | 10/2016 | Hallundbæk | E21B 43/1195 |

(Continued)

FOREIGN PATENT DOCUMENTS

WO 2007145617 A1 12/2007

OTHER PUBLICATIONS

MacAndrew, Robert et al., "Drilling and Testing Hot, High-Pressure Wells", Oilfield Review, Apr./Jul. 1993, p. 15-32, vol. 5-Issue 2.

(Continued)

*Primary Examiner* — Kipp C Wallace
(74) *Attorney, Agent, or Firm* — Cantor Colburn LLP

(57) ABSTRACT

A method of pressure testing downhole tubular connections includes connecting a pressure monitoring device to a test port on a downhole connector of a downhole tool, connecting the pressure monitoring device to a reference port, pressurizing the test port and the reference port, and monitoring for a pressure difference between the test port and the reference port with the pressure monitoring device.

12 Claims, 3 Drawing Sheets

(56) References Cited

U.S. PATENT DOCUMENTS

| | | | | |
|---|---|---|---|---|
| 2002/0020525 | A1* | 2/2002 | Willauer | E21B 33/134 166/187 |
| 2003/0196493 | A1* | 10/2003 | Mallison | E21B 47/06 73/716 |
| 2004/0253734 | A1 | 12/2004 | Firmin | |
| 2008/0121400 | A1 | 5/2008 | Allen | |
| 2009/0218095 | A1* | 9/2009 | Gordon | E21B 33/1294 166/250.01 |
| 2015/0176376 | A1* | 6/2015 | Gisolf | E21B 43/12 166/250.01 |

OTHER PUBLICATIONS

International Search Report and Written Opinion of the International Searching Authority issued in related PCT Application No. PCT/US2015/061204 dated Jan. 28, 2016, 10 pages.

* cited by examiner

METHOD AND SYSTEM FOR PRESSURE TESTING DOWNHOLE TUBULAR CONNECTIONS USING A REFERENCE PORT

BACKGROUND

Hydrocarbon exploration and recovery systems, as well as $CO_2$ sequestration systems, include one or more downhole strings that extend through a formation. The downhole strings include multiple tubulars that are joined together and guided down a wellbore. In certain cases, the tubulars may include various sensors that monitor various wellbore and/or fluid parameters. In many cases, the sensors are connected to a control line that extends uphole. The control line is typically passed to the sensor through a fluid tight connection.

Typically, the connections are pressure tested to ensure that the connector is sound. Generally, a pressure test of a connection may take anywhere from 40-90 minutes of wait time to allow for pressures and temperatures to stabilize. Given the large number of connections on a typical downhole string, pressure testing may have a considerable impact on installation time. Increasing installation time results in mounting costs associated with downhole activities. Accordingly, the hydrocarbon recovery and exploration industry, as well as the $CO_2$ sequestration industry, would welcome advances in pressure testing connections that reduce installation time.

SUMMARY

A method of pressure testing downhole tubular connections includes connecting a pressure monitoring device to a test port on a downhole connector of a downhole tool, connecting the pressure monitoring device to a reference port, pressurizing the test port and the reference port, and monitoring for a pressure difference between the test port and the reference port with the pressure monitoring device.

A downhole connector pressure testing system includes a pump, a pressure monitoring device, a reference port operatively coupled to the pressure monitoring device through a first conduit, and a second conduit operatively coupled to the pressure monitoring device, and a test port on the downhole connector.

A downhole system includes an uphole portion having a wellbore parameter monitoring system, a downhole portion including a downhole string having at least one downhole tool, at least one sensor arranged in the downhole tool, a wireline operatively connecting the at least one sensor and the downhole parameter monitor, a downhole connector operatively coupling the wireline to the downhole tool, and a downhole connector pressure testing system for checking integrity of the downhole connector. The downhole connector testing system includes a pump, a pressure monitoring device, a reference port operatively coupled to the pressure monitoring device through a first conduit, and a second conduit operatively coupled to the pressure monitoring device, and a test port on the downhole connector.

BRIEF DESCRIPTION OF THE DRAWINGS

Referring now to the drawings wherein like elements are numbered alike in the several Figures.

DETAILED DESCRIPTION

Figure 1:
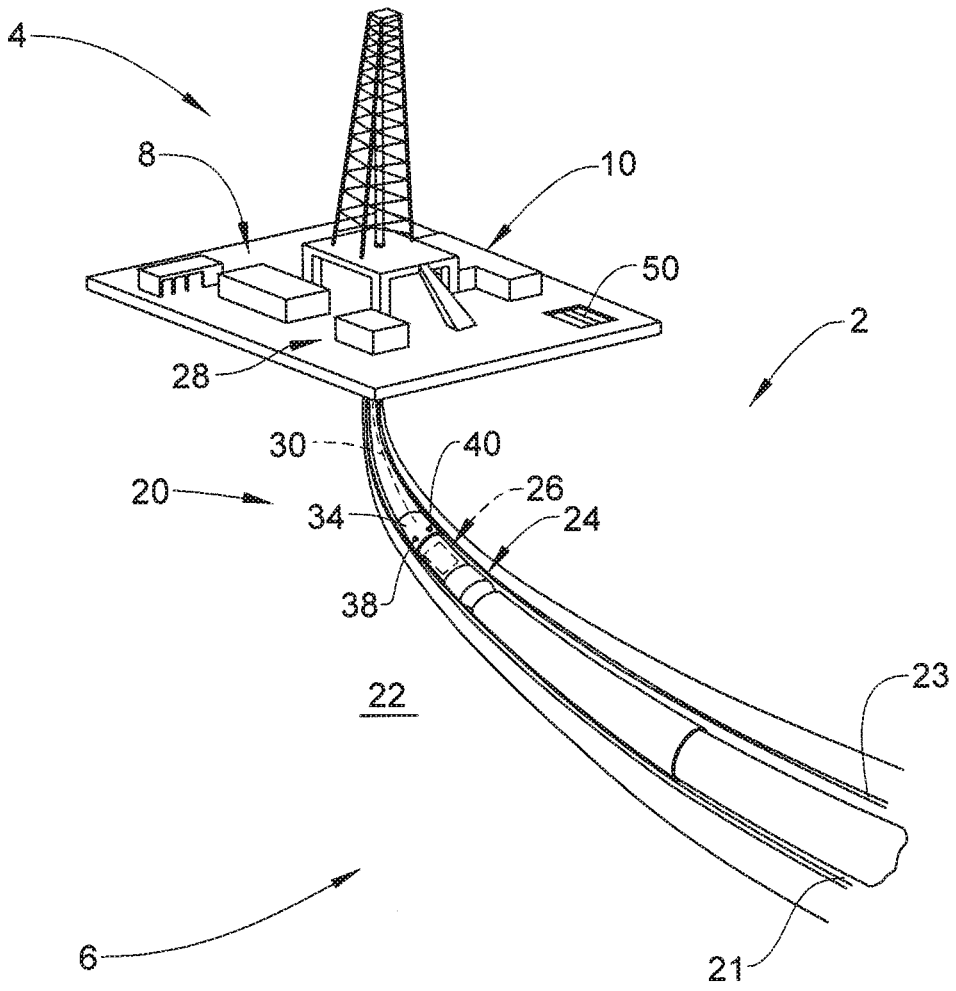
FIG. 1 depicts a downhole system including a downhole connector and a downhole connector pressure testing system, in accordance with an exemplary embodiment.

A downhole system, in accordance with an exemplary embodiment, is indicated generally at 2, in FIG. 1. Downhole system 2 includes an uphole portion 4 operatively connected to a downhole portion 6. Uphole portion 4 may include pumps 8 that aid in completion and/or extraction processes as well as a fluid storage portion 10. Fluid storage portion 10 may contain a fluid that may be introduced into or removed from downhole portion 6. Downhole portion 6 may include a downhole string 20 that extends into a wellbore 21 formed in formation 22. Wellbore 21 may include a wellbore casing 23.

Downhole string 20 may include a number of connected downhole tools 24. One or more of tools 24 may include one or more sensors 26. Sensors 26 are operatively connected to a wellbore parameter monitoring system 28 arranged uphole via a wireline 30. Sensors 26 may detect various wellbore parameters such as temperature, pressure and/or flow. Accordingly, sensors 26 may take on a variety of forms including fiber optics, electrical, hydraulic, and the like. In accordance with an exemplary embodiment, a downhole connector 34 operatively couples wireline 30 and sensor 26. Connector 34 provides a fluid tight and pressure tight seal for sensor(s) 26.

In accordance with an aspect of an exemplary embodiment, connector 34 includes a test port 38 fluidically connected to an internal portion (not separately labeled) housing sensor(s) 26. The internal portion includes a volume (also not separately labeled). Connector 34 may also include a reference port 40 that may be connected to a downhole connector pressure testing system 50 prior to being introduced downhole, as will be detailed more fully below. Reference port 40 includes a reference volume (also not separately labeled) substantially equal to that of the volume of the internal portion.

Figure 2:
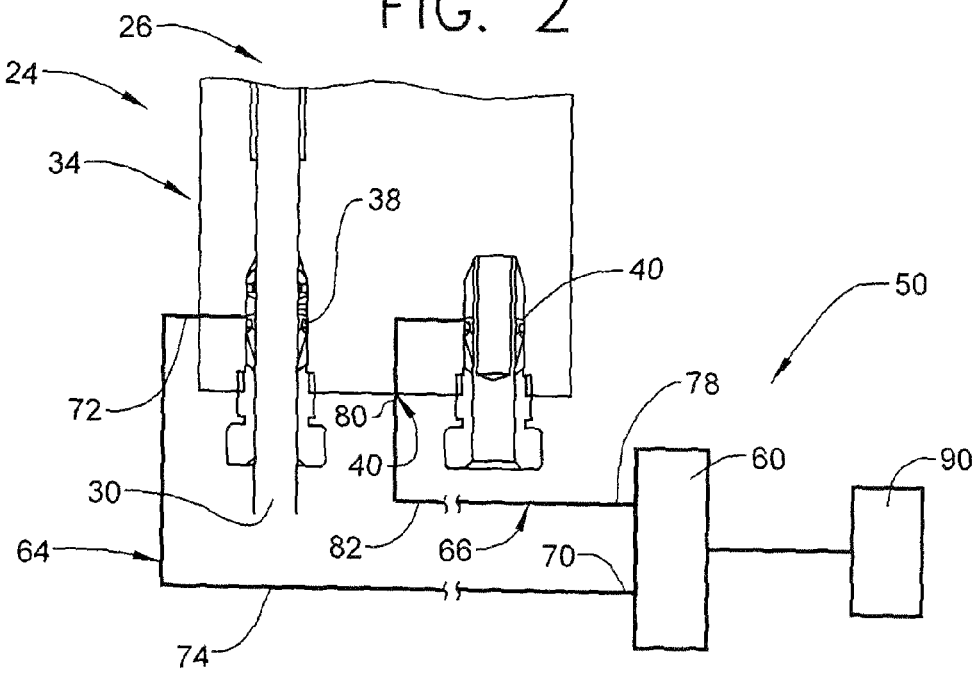
FIG. 2 depicts the downhole connector pressure testing system of FIG. 1.

In accordance with an aspect of an exemplary embodiment illustrated in FIG. 2, downhole connector pressure testing system 50 includes a pressure monitoring device 60 that is coupled to test port 38 through a first conduit 64 and to reference port 40 through a second conduit 66. First conduit 64 includes a first end 70, a second end 72 and an intermediate portion 74 extending therebetween. First conduit 64 includes a first internal volume (not separately labeled). Similarly, second conduit 66 includes a first end 78, a second end 80 and an intermediate portion 82 extending therebetween. Second conduit 66 includes a second internal volume (also not separately labeled) that is substantially equal to the first internal volume of first conduit 64. More specifically, first and second conduits 64 and 66 include substantially identical lengths (inclusive of portions within connector 34) and thus include substantially equal internal volumes.

Downhole connector pressure testing system 50 also includes a pump 90 which, in the exemplary embodiment shown, is operatively connected to pressure monitoring device 60. In operation, pump 90 introduces a fluid pressure into test port 38 and reference port 40. The fluid pressure may be a positive pressure or a negative pressure (vacuum). Once the fluid pressure reaches a selected hold pressure level, pressure monitoring device 60 monitors for any pressure differences between test port 38 and reference port 40. A pressure difference that exceeds a selected threshold may indicate that connector 34 may not be properly installed, or may be faulty in some way. By using a test port 38 and a reference port 40 each having substantially equal volumes, along with conduits 64 and 66 that also have substantially equal volumes, there is no need to wait for pressures to stabilize and adjust to ambient conditions before testing may begin. Specifically, as all volumes are exposed to the same environmental conditions, testing may begin as soon as the selected hold pressure level has been reached. Thus, in contrast to single conduit systems which require a wait period as long as ninety minutes or more to allow pressure to stabilize, the present invention may perform a test in 15 minutes or less.

Figure 3:
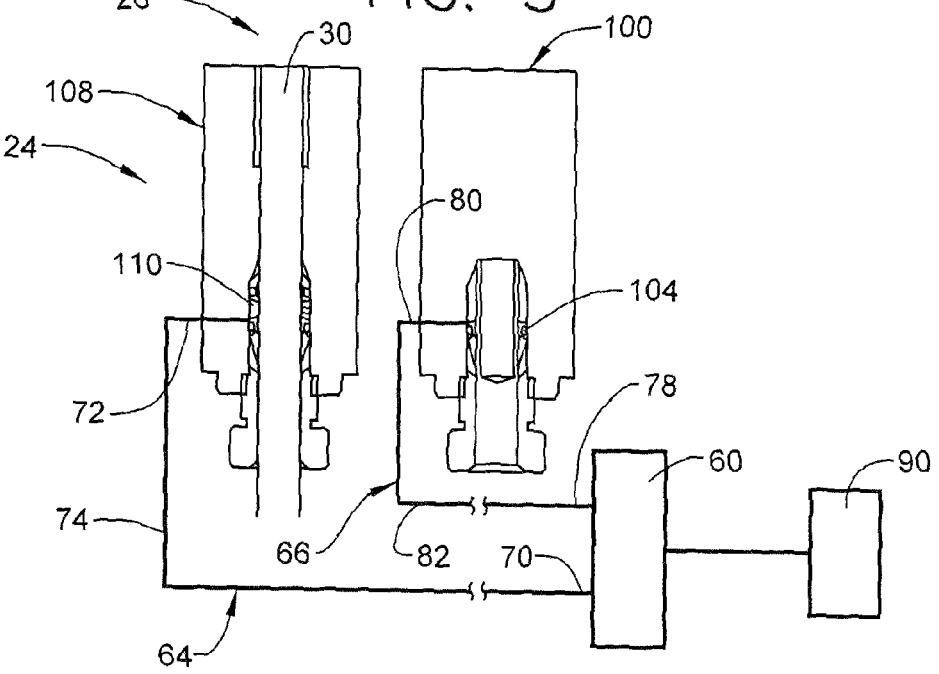
FIG. 3 depicts a downhole connector pressure testing system, in accordance with another aspect of an exemplary embodiment.

Reference will now follow to FIG. 3, wherein like reference numbers represent corresponding parts in the respective views. In accordance with an aspect of an exemplary embodiment, downhole connector pressure testing system 50 may include a reference element 100 having a reference port 104. Reference element 100 may be employed when downhole tool 24 includes a connector 108 having a test port 110 but no reference port. In such cases, a reference element 100 is selected having a reference volume (not separately labeled) that is similar to the test volume (also not separately labeled) in the connector 108. In this manner, connector 108 may be tested without the need to wait for pressures to stabilize and adjust for ambient conditions.

Figure 4:
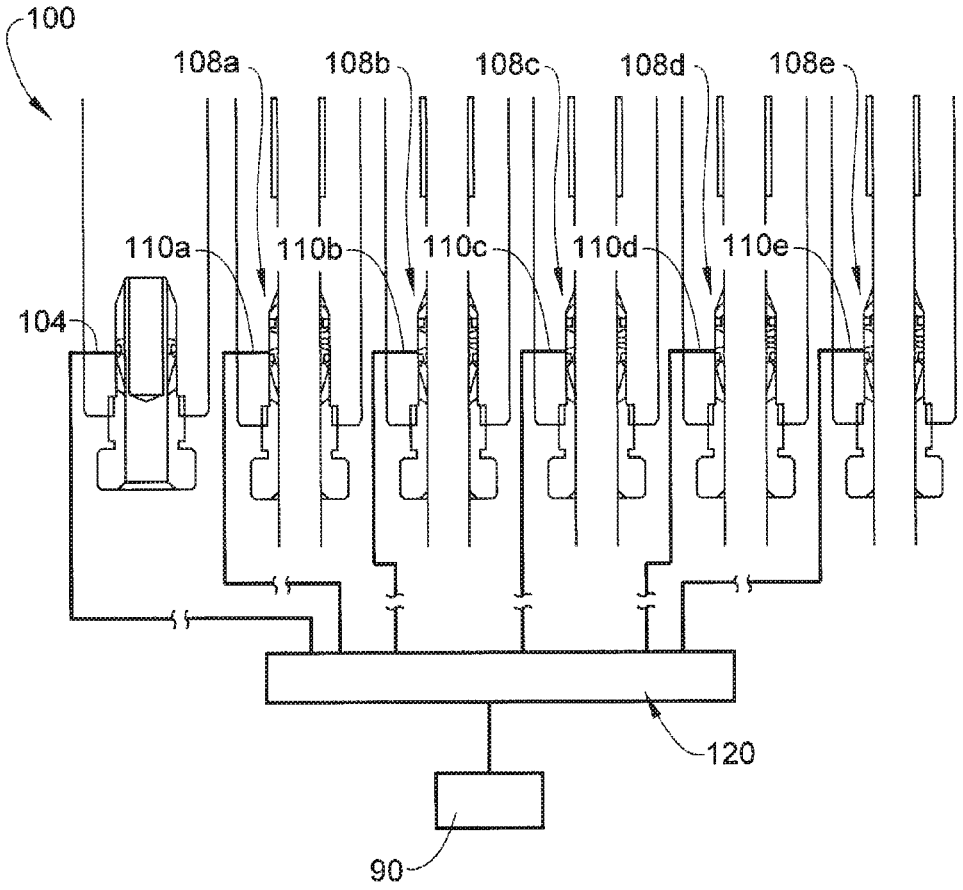
FIG. 4 depicts a downhole connector pressure testing system, in accordance with yet another aspect of an exemplary embodiment.

At this point, it should be understood that the exemplary embodiments describe a method and system for testing downhole connector integrity without needing to wait for pressures to stabilize and adjust for ambient conditions. In this manner, downhole connectors may be tested and introduced downhole more quickly saving operational and testing costs. It should also be understood that reference elements may be produced with various reference volumes to accommodate downhole connectors of various sizes and configurations. Further, it should be understood that multiple downhole connectors may be tested simultaneously. For example, as shown in FIG. 4, reference element 100 may be fluidically coupled to a multi-connector pressure monitoring device 120 along with a plurality of downhole connectors 108*a*-108*e*, each having an associated test port 110*a*-110*e*. In this manner, testing time, as well as installation time, may be further reduced.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. A method of testing downhole tubular connections comprising:

connecting a pressure monitoring device to a test port on a downhole connector of a downhole tool through a first conduit;

connecting the pressure monitoring device to a reference port through a second conduit;

pressurizing at least one of the test port and the reference port through a pump fluidically connected to a corresponding one of the first and second conduits; and monitoring for a pressure difference between the test port and the reference port with the pressure monitoring device to determine an operational integrity of the downhole connector.

2. The method of claim 1, wherein connecting the pressure monitoring device to the test port includes connecting a first conduit having a first volume to the test port and connecting the pressure monitoring device to the reference port includes connecting a second conduit having a second volume to the reference port, the second volume being substantially equal to the first volume.

3. The method of claim 1, wherein pressurizing the test port and the reference port includes introducing a positive pressure to each of the test port and the reference port.

4. The method of claim 1, wherein connecting the pressure monitoring device to the reference port includes connecting the pressure monitoring device to a reference port integrally formed with one of the downhole connector and the downhole tool.

5. The method of claim 1, wherein connecting the pressure monitoring device to the reference port includes connecting the pressure monitoring device to a reference port arranged remote from the downhole connector.

6. The method of claim 1, wherein connecting the pressure monitoring device to test port includes connecting the pressure monitoring device to a plurality of test ports associated with one or more downhole tools.

7. A downhole connector pressure testing system comprising:

a pump;

a pressure monitoring device operable to determine an operational integrity of a downhole connector;

a reference port provided in the downhole connector, the reference port being operatively coupled to the pressure monitoring device and the pump through a first conduit; and a test port provided in the downhole connector, the test port being operatively coupled to the pressure monitoring device and the pump through a second conduit.

8. The downhole connector pressure testing system according to claim 7, wherein the reference port is integrated into the downhole connector.

9. The downhole connector pressure testing system according to claim 7, wherein the first conduit includes a first internal volume and the second conduit includes a second internal volume that is substantially equal to the first internal volume.

10. A downhole system comprising:

an uphole portion including a wellbore parameter monitoring system;

a downhole portion including a downhole string having at least one downhole tool;

at least one sensor arranged in the downhole tool;

a wireline operatively connecting the at least one sensor and the wellbore parameter monitoring system;

a downhole connector operatively coupling the wireline to the downhole tool; and a downhole connector pressure testing system for checking integrity of the downhole connector, the downhole connector testing system including:

a pump;

a pressure monitoring device operable to determine an operational integrity of the downhole connector;

a reference port provided in the downhole connector, the reference port being operatively coupled to the pressure monitoring device and the pump through a first conduit; and a test port provided in the downhole connector, the test port being operatively connected to the pressure monitoring device and the pump through a second conduit.

11. The downhole system according to claim 10, wherein the reference port is integrated into the downhole connector.

12. The downhole system according to claim 10, wherein the first conduit includes a first internal volume and the second conduit includes a second internal volume that is substantially equal to the first internal volume.

* * * * *